United States Patent [19]

Parizot et al.

[11] Patent Number: 4,848,474

[45] Date of Patent: Jul. 18, 1989

[54] MODULAR SUBSEA STATION ON A MONOPODIAL STRUCTURE

[75] Inventors: Claude Parizot, Pau; Claude Boj, Lescar; Jean C. Schawann, Bizanos, all of France

[73] Assignee: Societe Nationale Elf Aquitaine (Production), Paris, France

[21] Appl. No.: 212,659

[22] Filed: Jun. 28, 1988

[30] Foreign Application Priority Data

Jun. 29, 1987 [FR] France ..... 87 09123

[51] Int. Cl.[4] ..... E21B 7/12; E21B 43/017

[52] U.S. Cl. ..... 166/366; 166/339; 166/341; 166/351

[58] Field of Search ..... 166/366, 341, 339, 351, 166/360, 347; 405/195; 175/7, 8, 9

[56] References Cited

U.S. PATENT DOCUMENTS

| | | | |
|---|---|---|---|
| 3,517,735 | 6/1970 | Fairbanks et al. | 166/366 |
| 3,552,903 | 1/1971 | Townsend, Jr. | 166/366 X |
| 3,643,736 | 2/1972 | Talley, Jr. | 166/366 X |
| 4,023,619 | 5/1977 | Marquaire et al. | 166/366 X |
| 4,120,362 | 10/1978 | Chateau et al. | 166/339 |
| 4,442,900 | 4/1984 | Padilla et al. | 166/366 X |
| 4,625,805 | 12/1986 | Ladecky | 166/341 |
| 4,643,616 | 2/1987 | Castle et al. | 166/338 X |

*Primary Examiner*—Stephen J. Novosad

*Attorney, Agent, or Firm*—Poms, Smith, Lande & Rose

[57] ABSTRACT

The field of crude oil exploitation on a sub-marine site. The station comprises a platform 1 of octagonal shape carried by a central column 2 anchored in the ground on which is fixed an effluent collecting module 5. Stacked on the said module is a central control module 60. Fixed in overhanging fashion on six sides of the octagon are frames 10 to 15 adapted to overhang drilling wells and each carrying a production head 30, 40. On the other two sides of the octagon, fixed by means of frames, there are an umblical head 80 and a connecting module 70 for the discharge of effluent.

This arrangement makes it possible to bring a certain number of wells close to the platform and so shorten the distances between the modular units.

6 Claims, 3 Drawing Sheets

Figure 1:
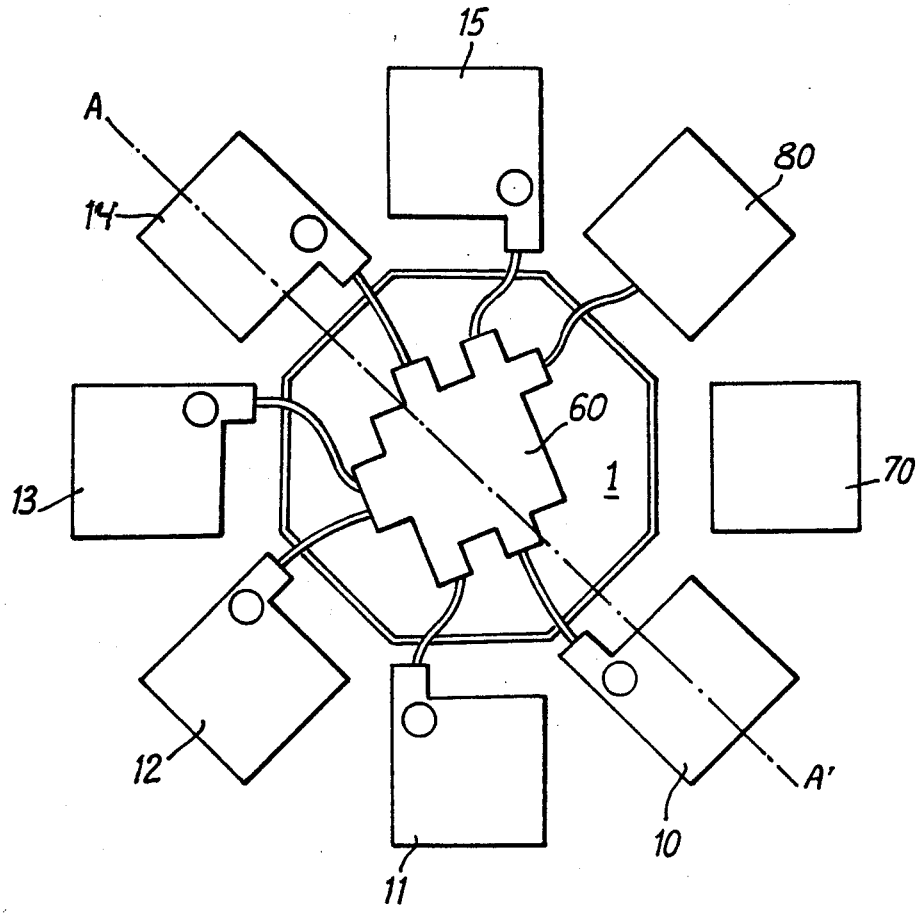

50
50
50
50
50
50
50a
8
7
70
71
59
56
58
57
6
41
51a
51b
52
51
40
30

MODULAR SUBSEA STATION ON A MONOPODIAL STRUCTURE

The present invention relates to oil producing installations housed in sub-marine stations at considerable depths.

Such stations can be set in place, maintained and monitored without direct intervention, by means of automatic monitoring systems. U.S. Pat. Nos. 4,120,362 and 4,625,805 owned by a common assignee describe such sub-marine stations which comprise a rectangular base frame which forms a rigid jig placed on the sea bottom and provided with a plurality of sites adapted to receive modular assemblies. The said sites receive such modular assemblies through a guide base which has four guide columns. One of them may consist of a well head gear consisting of a safety lock above which there is a production unit carrying automatic and remote control equipment housed in the form of containers in housings provided on the upper face of the casing covering the said production unit.

Such a double module thus comprises two modules stacked by means of guide columns.

According to U.S. Pat. No. 4,625,805, in a peripheral zone adjacent the two opposite sides of the rectangular frame, there are sites for such well head equipment sets, while a central area of the frame constitutes a site adapted to receive stacked modular units such as a connecting unit and a peripheral monitoring unit, while there is in the centre a site for a central station control unit.

Each modular unit is provided with guide means, the geometry of which corresponds to that of the guide means disposed either on the guide bases fixed to the frame or on subjacent modules. Such installations do have drawbacks. The pipework for collecting effluent from the well head and starting from the well head must first of all be connected to the connection module and then negotiate considerable distances before ending at the discharge lines. Similarly, automatic electrohydraulic connection of the connection module to the multi-connector receptacles of the well head production unit is not easy when the distance between the said module and the well head increases.

Indeed, an installation disposed on a rectangular frame will accept only a limited number of well heads by virtue of the distance separating these heads from the connection modules and peripheral monitoring modules, and also the central monitoring module.

What is more, as the sea bottom has considerable differences in level, it is very difficult to achieve a flat positioning on such a sea bottom of a frame which is of substantial diameter.

The object of the present invention is to offset these disadvantages. It proposes an oil producing modular sub-marine station on a monopod framework comprising a platform of octagonal shape carried by a central column anchored to the ground and on which there is an effluent collecting module, on which a central control module is stacked by guide columns, while on at least one of six sides of the octagonal platform there is an overhanging frame designed to overhang a drilling well and carrying a production head comprising a security unit on which the production unit is stacked by means of guide columns, the other two sides of the octagonal platform carrying, fixed on frames, an umbilical head or processing centre at which terminate the surface conduits and cables for electrohydraulic control and a connecting module for the evacuation or injection of effluent.

Figure 2:
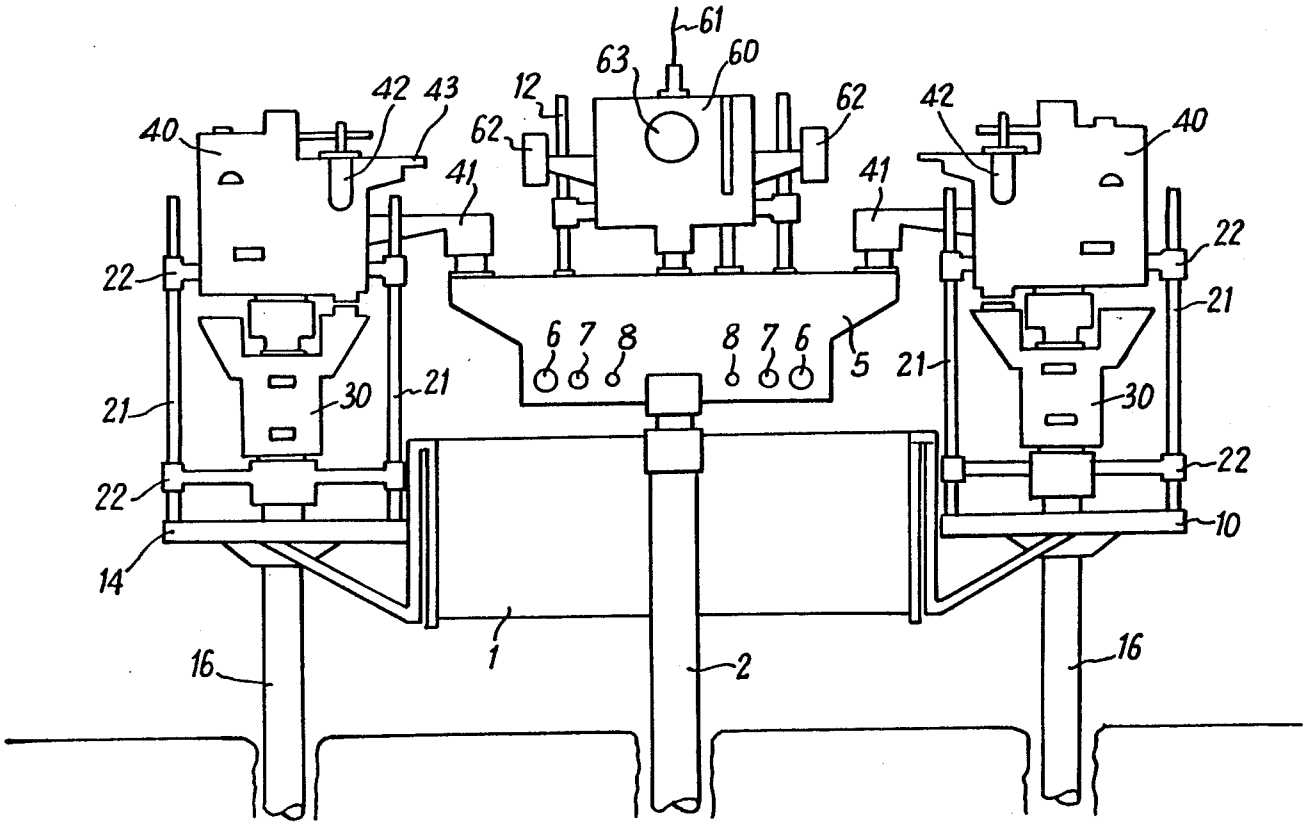
Figure 3:
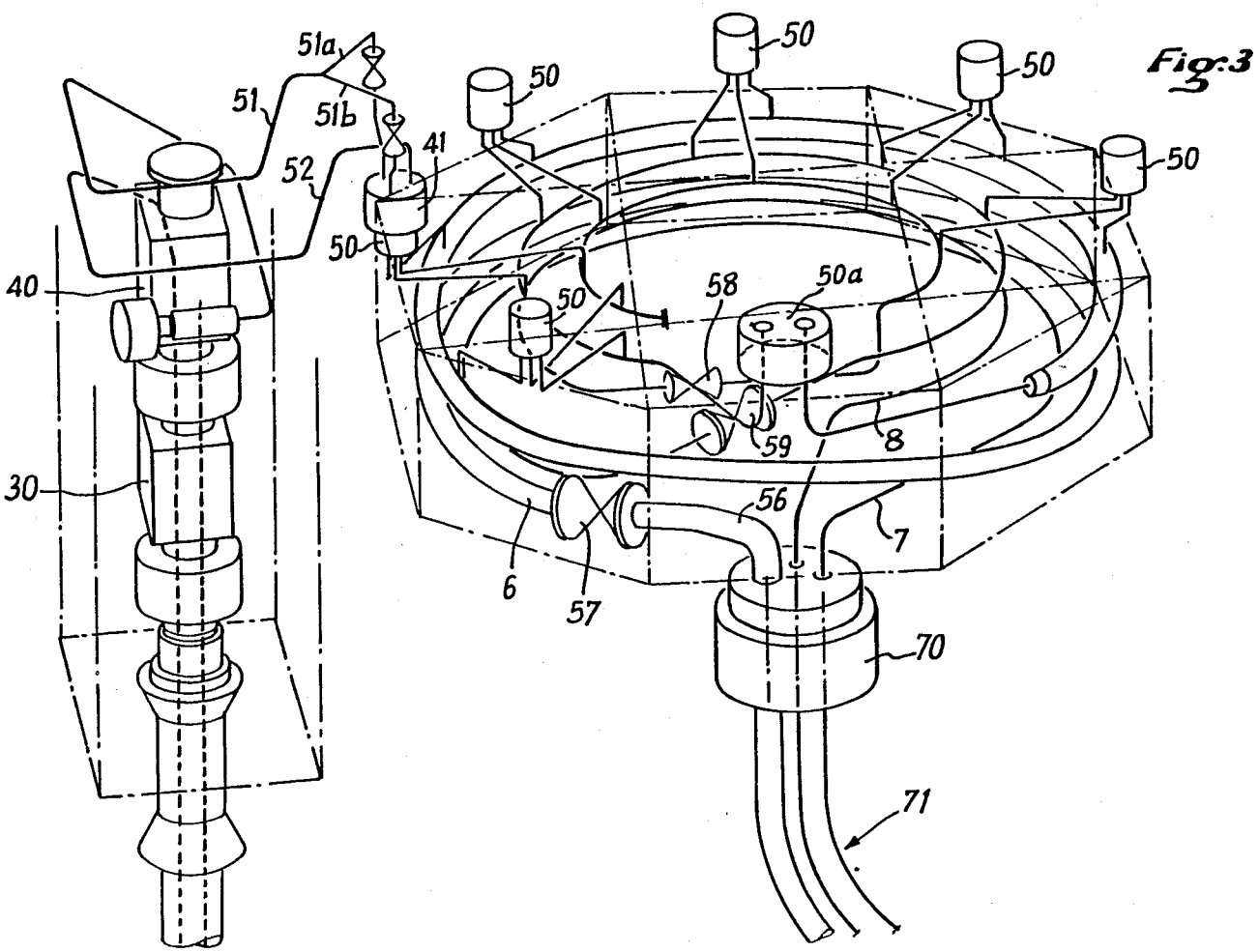

Other particular features of the invention will become evident from the description of an embodiment illustrated by the accompanying drawings, in which:

FIG. 1 diagrammatically shows a plan view of the installation;

FIG. 2 shows a side view in a section taken on the line A—A' in FIG. 1, and FIG. 3 shows the collection module and its network in a perspective view.

The octagonal platform 1 is carried by a central column 2 which is fixed in the sea bottom. Six of the sides of the octagonal platform carry frames 10 to 15 on which rest six production heads.

Each production head consists of a bottom part or safety block 30 and an upper part or production block or unit 40. The production unit contains the sensitive components such as sensors, nozzles, process and safety valves as well as the remote control means associated with the production head. Should one of the components fail, the production unit is raised and replaced by an identical unit. During this operation, carried out without the help of a diver, closure of the bottom unit helps to ensure the safety of the well. Each frame 10 to 15 carries four guide columns 21 on which there are mounted, over the drilling well 16, by means of guide sleeves 22, the safety unit 30 and the production unit 40, rigid with these sleeves.

Each production unit carries an oil connection connector 41. Each well head is monitored by an electrohydraulic assembly 42 integrated into the unit.

Above the platform 1 there is anchored to the central column 2 a collecting module 5. Locked onto the base platform this module provides for transfer of fluids between the six wells and the connecting network, and in particular it comprises production effluent outlets at 6, inidividual well test fluids at 7 and service lines, for example a lift gas annular assembly at 8.

The effluent collector is shown in detail in FIG. 3.

The module 5 which is of octagonal shape consists of welded tubes for protecting the conduits which it encloses. It is provided with six male multi-passage connectors 50 corresponding to the six well heads 30, 40. Each production unit 40 is linked by a production line 51 which, by means of two branches, one 51a and the other 51b, for individual test purposes, terminates like the service line 52 in a female connector 41 which fits over the male connector 50.

Three lines of collectors emerge from each connector 50, the lines emanating from each connector relative to a well being connected into three grouped lines: test line 7, service line 8, for example for a gas lift, and a production line 6. All the lines are fitted with valves 58, 59 and in particular the production line 6 which is fitted with an isolating valve 57 capable of being actuated by a remote controlled vehicle. It makes it possible to isolate the station from the flow lines in order to avoid discharging oil into the sea when a production unit is closed down.

After having completed a number of loops inside the octagon to ensure greater flexibility of handling, the three lines 6, 7 and 8 terminate in a connection module 70 for connecting three ducts to the flow line system 71.

A multipassage connector **50*a*** makes it possible to raise a remote controlled valve situated downstream of the production and test circuit. This valve isolates the two circuits in normal operation and makes it possible to link them if required.

The module 5 carries on its upper surface guide columns 12 which serve to locate the central control unit 60. It serves to receive coded messages sent to it from the surface processing centre through a microprocessor 63 and a coaxial connecting cable 61. The hydraulic power is likewise supplied to it from the processing centre by an umbilical link. The series of umbilical links connected to the processing centre passes through a module 80 fixed to one of the frames moored to the sides of the octagonal platform 1. Module head 80 provides terminals for umbilical electrohydraulic connections such as ducts and cables extending from a surface monitor and control unit, both of which may be stationed a distance from an offshore station for supplying information from the control unit to production modules associated with the offshore station.

The connections between this module and the central control unit 60 are made by a telemanipulator or robot.

The electrohydraulic links between the central unit 60 and the production units 40 are made by fitting the male multiconnectors 62 carried by the unit 60 into corresponding receptacles 43 in production units, using autonomous manipulators as described in U.S. Pat. No. 4,643,616 owned by a common assignee.

We claim:

1. In a modular oil producing submarine station, the combination of:

a monopod frame comprising a central column anchored in the ground, a platform a polygonal shape supported on said column;

an effluent collecting module at said platform, guide columns on said effluent collecting module;

a central control module guided on said guide columns and supported from said effluent collecting module;

an overhanging frame structure extending from at least one of said sides of said polygonal platform and arranged to overhang an adjacent wall;

a production head on said overhanging frame structure and including a safety unit and a production unit;

an umbilical head supported from another side of said polygonal frame and at which are terminated conduits and surface cables for controlling and transmitting electrical and hydraulic power; and a connecting module supported from another side of said polygonal frame for discharge of effluent received from said effluent collecting module.

2. A station according to claim 1 including an electrohydraulic assembly integrated into said production unit for control of each well head.

3. A station according to claim 1 wherein said central control module houses a central electrohydraulic assembly for distributing the electrical and hydraulic power and electrical signals, said central electrohydraulic assembly including a microprocessor for processing said signals which comprise coded messages.

4. A station according to claim 1 wherein said effluent collecting module is of corresponding polygonal shape as said platform and includes welded protected tubes comprising connections to production units of each well and three production lines, test lines, and surface lines, said three lines forming a plurality of flexible loops inside the collecting module before terminating at said connecting module, said connecting module providing connections to flow lines.

5. In a modular oil producing submarine station, the combination of:

a monopod frame means comprising a central column anchored in the ground and a platform of selected shape supported on said column;

an effluent collecting module positioned above said platform;

a central control module supported from said effluent collecting module;

a frame structure extending from a portion of said platform and arranged to overhang an adjacent well;

production means on said overhanging frame structure for connection to said well;

an umbilical head means supported from another part of the frame and providing terminals for conduits and surface cables for controlling and transmitting electrical and hydraulic power;

and a connecting module supported from another portion of said frame and having connection to said production head means and for discharge of effluent.

6. A station as claimed in claim 5 wherein said production head means includes a safety unit and a production unit.

* * * * *